United States Patent [19]

Kasai et al.

[11] 4,297,315

[45] Oct. 27, 1981

[54] METHOD OF MAKING WIG ARCHETYPE

[75] Inventors: Goro Kasai, Ichikawa; Sanjuro Takechi; Hiroshi Harima, both of Hasaki, all of Japan

[73] Assignee: Kuraray Company, Ltd., Kurashiki, Japan

[21] Appl. No.: 107,564

[22] Filed: Dec. 27, 1979

[30] Foreign Application Priority Data

Dec. 29, 1978 [JP] Japan ..... 53/161914

[51] Int. Cl.[3] ..... B29C 17/00

[52] U.S. Cl. ..... 264/322; 132/5; 132/54; 264/132; 264/222; 264/331.13; 264/DIG. 30

[58] Field of Search ..... 264/222, 223, 322, 331, 264/DIG. 30, 316, 132; 132/5, 53, 54

[56] References Cited

U.S. PATENT DOCUMENTS

| | | | |
|---|---|---|---|
| 2,330,732 | 9/1943 | Oestrike | 264/222 |
| 3,322,873 | 5/1967 | Hitchcock | 264/222 |
| 3,421,521 | 1/1969 | Rich, Jr. | 132/5 |
| 3,490,444 | 1/1970 | Larson | 264/222 |
| 3,550,158 | 12/1970 | Natta et al. | 526/335 |
| 3,626,954 | 12/1971 | Ostrom | 264/222 |
| 3,819,796 | 6/1974 | Webster et al. | 264/322 |

*Primary Examiner*—James B. Lowe

*Attorney, Agent, or Firm*—Oblon, Fisher, Spivak, McClelland & Maier

[57] ABSTRACT

A method for creating a wig archetype to the shape of the human head, comprising:

a. softening a sheet of a thermoplastic composition comprising polyisoprene, said polyisoprene having at least 90% of the isoprene monomer units in the trans-1,4 configuration and an intrinsic viscosity of 1.2 to 3 when measured in toluene at 30° C;

b. applying the sheet to the scalp of a human head;

c. hardening the sheet; and d. removing the sheet from the scalp.

8 Claims, No Drawings

METHOD OF MAKING WIG ARCHETYPE

BACKGROUND OF THE INVENTION

1. Field of the Invention

This invention relates to a sheet for making a wig archetype which conforms to the shape of a human head.

2. Description of the Prior Art

Methods are known for reproducing the shapes of three-dimensional body members. For example, archetypes for the base cap of wigs have previously been formed by placing four or more pieces of transparent film on a head, tracing the unevenness and hair density distribution thereof and sticking an adhesive tape or the like to the film pieces. Net or woven fabric is then attached to the film in accordance with the tracing and a cloth tape or the like is superimposed over the resulting fitted shape. The pieces are then sewn together to complete the base cap archetype.

Unfortunately, this method requires much time and labor. Moreover, when the archetype consisting of the adhesive tape and the transparent film pieces upon which the unevenness and hair density distribution have been traced is removed from the head and/or when the pattern of the archetype is transferred to the base cap, the archetype is deformed to a significant extent. This deformation makes it difficult to manufacture wigs that closely fit the head. Thus, the conventional methods for copying heat- and force-sensitive body members such as the head require time and skill and, even when much labor is devoted, it is still difficult to copy the members exactly and precisely.

A need, therefore, continues to exist for a method by which wig archetypes can be easily and accurately fabricated.

SUMMARY OF THE INVENTION

Accordingly, an object of the present invention is to provide a method by which wig archetypes, which conform to the shape of a head, can be easily and accurately prepared.

Briefly, this and other objects of the present invention as hereinafter will become more readily apparent can be attained by a method for creating a wig archetype to the shape of the human head comprising (a) softening a sheet of a thermoplastic composition comprising polyisoprene, said polyisoprene having at least 90% of the isoprene monomer units in the trans-1,4 configuration and an intrinsic viscosity of 1.2 to 3 when measured in toluene at 30° C.; (b) applying the sheet to the scalp of a human head; (c) hardening the sheet; and (b) removing the sheet from the scalp.

DETAILED DESCRIPTION OF THE PREFERRED EMBODIMENTS

It has been found that in order to provide a technique which is capable of accurately and rapidly duplicating the shape of a particular human body member, especially those members which are sensitive to heat, force and chemical actions, without damaging or contaminating the human body, it is necessary to use a duplicating material which has the following characteristics:

1. The material should be sufficiently soft so that it is capable of flowing at relatively low temperatures, namely at temperatures which the human body can endure. It should be applicable to the human body or the like and should be able to be shaped to human body members. Moreover, the material should exhibit the characteristic that after application and shaping, it should harden upon coating. Further, the material should not cause any degeneration or contaminate the object to which it is applied such as the skin of the human body.

2. The material should also possess the characteristic that the time necessary for it to change from its softened state to a solidified state, that is the working like, can easily be controlled.

3. After application of the material, it should exhibit sufficient elastic recovery characteristics, hardness and strength to make it possible to remove it easily without deformation. Moreover, the archetype product obtained should also exhibit such a degree of elasticity, hardness and strength that it will not deform under stress.

It has now been found that the above requirements can be fulfilled by a thermoplastic composition composed principally of trans-1,4-polyisoprene having a trans-1,4 content of not less than 90 percent and an intrinsic viscosity as measured in toluene at 30° C. of 1.2 to 3.0. A preferred embodiment of the present invention is a sheet made from the trans-1,4-polyisoprene thermoplastic composition which has a thickness of 0.5 to 4 millimeters and which is most suitable for fabricating a wig archetype prior to the manufacture of a base cap.

The sheet fulfills all the above requirements, and is sufficiently transparent when held to the head to register the hair density distribution before solidification, because after completion of the copying, the sheet turns into an opaque body thereby providing clear registration of the hair density distribution which can be clearly seen when implanting the base cap with hair. The sheet does not undergo deformation and therefore possesses excellent workability.

The trans-1,4-polyisoprene used in the present invention melts and acquires fluidity when allowed to stand in ambient air at a temperature not lower than 70° C. When allowed to stand at room temperature, the melted composition gradually solidifies (hardens) and crystallizes over a period of several minutes to several hours. The final crystallinity is 20–60 weight percent. This trans-1,4-polyisoprene has a glass transition point of about −68° C. and has a rubber elasticity at room temperature. If the trans-1,4 content is substantially less than 90 weight percent, the trans-1,4-polyisoprene becomes inadequately crystalline; the rate of crystallization (solidification) is low; and the final product shows a diminished hardness such that it cannot have a Shore hardness of at least 85, which is required of a sheet used in the preparation of a wig archetype for a wig base cap. Such a sheet, therefore, cannot practically be used in the present invention. Furthermore, if the molecular weight of the trans-1,4-polyisoprene is too low, the polyisoprene will too easily change its form during melting and shaping. Conversely, if the molecular weight is too high, a decreased fluidity will result, making it difficult to copy the shape of the head. Therefore, the intrinsic viscosity as measured in toluene at 30° C. should be in the range of 1.2 to 3.0.

The trans-1,4-polyisoprene used in the present invention may be a synthetic product derived from the polymerization of monomeric isoprene over a Ziegler-type catalyst. The trans-1,4-polyisoprene may also be a natural trans-polyisoprene such as balata or gutta-percha. Mixtures of the synthetic and natural polymers can also be used. Synthetic trans-1,4-polyisoprene is most preferred since it contains no contaminants and is always of a uniform quality.

Although the present invention is directed primarily to a composition composed mainly of trans-1,4-polyisoprene, it is possible to add ethylene-vinyl acetate copolymer, other plastics, natural rubber, synthetic polyisoprene rubber, polybutadiene rubber, styrene-butadiene copolymer, other solid or liquid rubbers, process oil and the like, to control (or lengthen) the working life of the polymer with the level of addition being not more than 100 parts by weight per 100 parts by weight of trans-1,4-polyisoprene. For further increase in hardness after cooling and solidfication, there may be added not more than 100 parts by weight of such inorganic fillers as zinc oxide, titanium oxide, calcium carbonate, clay and hydrated silica. In some cases where transparency is required, it is preferable not to add an inorganic filler. Additives ordinarily used in the rubber industry for improving the stability or appearance of the composition, such as antioxidants, dyes and the like, may also be employed.

The thermoplastic composition of the present invention is formed into a sheet of the above-specified thickness, which is supplied to the user. The user softens a desired amount of the material by treatment in a water or air bath, by subjecting it to a blast of hot air, or by heating it on a heated plate at temperatures of 70° C. or above. The material is then allowed to cool until it reaches a temperature at which it may safely be applied to the head. The material is then pressed against the head in order to copy the shape thereof. If the sheet thickness is greater than 4 millimeters, the sheet will become too hard after application and solidification, thereby adhering to the head to a significant degree and making it difficult or impossible to remove the sheet easily. Another problem that may sometimes occur when the thickness is greater than about 4 millimeters is the loss of transparency causing difficulties in observing and registering the hair density distribution. If, conversely, the thickness is less than about 0.5 millimeters, the sheet may be too soft following application and solidification causing various problems such as deformation of the sheet after it is removed from the head.

Having generally described this invention, a more complete understanding can be obtained by reference to certain specific examples, which are provided herein for purposes of illustration only and are not intended to be limiting unless otherwise specified.

EXAMPLE 1

Trans-1,4-polyisoprene was mixed with ethylene-vinyl acetate copolymer or hydrated silica in the proportion specified in Table 1 (in parts by weight) by mill roller and a sheet having a thickness of about 2 millimeters was produced with a hot press at 100° C. Hot air was blown at the sheet by means of a hair drier which caused softening of the sheet, which was then held to the human head and shaped to the contours of the head. The sheet was removed after solidification. Thus an archetype was prepared for a base cap of a wig. The sheet could be quite satisfactorily and easily applied to the head and could easily be removed from the head. The working life of the archetype was satisfactory and the resulting archetype exactly produced the shape of the head. When the sheet was applied to the head, the hair density distribution could clearly be seen through the sheet and could easily be registered on the sheet. The working life of the sheet and the hardness of the archetype were as shown in Table 2. As is clear from Table 2, the hardness value was above 85 and therefore sufficient for practical purposes. After completion of the copying, the sheet turned into an opaque sheet, so that the registered hair density distribution could distinctly be seen and the implantation of the base cap with hair was easily accomplished.

TABLE 1

| Specimen No. | 1 | 2 | 3 | 4 |
|---|---|---|---|---|
| Synthetic trans-1,4-polyisoprene(1) | 100 | 100 | 100 | 100 |
| Ethylene-vinyl acetate copolymer(2) | 0 | 15 | 30 | 0 |
| Hydrated silica(3) | 0 | 0 | 0 | 50 |

(1)The trans-1,4 content is 99 wt. % and the intrinsic viscosity as measured in toluene at 30° C. is 2.97; Trans Polyisoprene TP-301 manufactured by Kuraray Isoprene Chemical Co., Ltd.
(2)Evaflex 250 manufactured by Mitsui Polychemical Co., Ltd.
(3)Nipsil $VN_3$ manufactured by Nippon Silica Co., Ltd.

TABLE 2

| Specimen No. | 1 | 2 | 3 | 4 |
|---|---|---|---|---|
| Working life (minutes) | 6 | 8 | 10 | 6 |
| Hardness (Shore A)(4) | 95 | 92 | 89 | 99 |

(4)According to JIS K 6301

Having now fully described the invention, it will be apparent to one of ordinary skill in the art that many changes and modifications can be made thereto without departing from the spirit or scope of the invention as set forth herein.

What is claimed as new and intended to be covered by Letters Patent is:

1. A method for making a wig archetype to the shape of the human head, comprising:

a. softening a sheet of a thermoplastic composition comprising polyisoprene, said polyisoprene having at least 90% of the isoprene monomer units in the trans-1,4 configuration and an intrinsic viscosity of 1.2 to 3 when measured in toluene at 30° C., said sheet having a thickness from 0.5 to 4.0 millimeters and said thermoplastic composition being sufficiently transparent when held to the head to allow registering of the hair distribution;

b. applying the sheet to the scalp of a human head, shaping said sheet to the shape of said human head and registering the distribution of the hair thereon by marking the location of the hair while said sheet is in contact with said human head;

c. hardening the sheet whereby the thermoplastic composition clearly shows the registered hair density distribution after hardening; and d. removing the sheet from the scalp.

2. The method of claim 1, wherein the trans-1,4-polyisoprene has a crystallinity after hardening of 20–60 weight percent.

3. The method of claim 1, wherein the trans-1,4-polyisoprene has a glass transition point of about −68° C.

4. The method of claim 1, wherein the thermoplastic composition has a rubber elasticity at room temperature.

5. The method of claim 1, wherein the thermoplastic composition has a Shore hardness of at least 85.

6. The method of claim 1, wherein the polyisoprene composition further comprises a component selected from the group consisting of ethylene-vinyl acetate copolymer, natural rubber, synthetic polyisoprene rubber, polybutadiene rubber and styrene-butadiene rubber.

7. The method of claim 6, wherein not more than 100 parts by weight of said component is combined with 100 parts by weight of said trans-1,4-polyisoprene.

8. The method of claim 1, wherein said composition further comprises an inorganic filler of zinc oxide, titanium oxide, calcium carbonate, clay or hydrated silica, the amount of said filler being not more than 100 parts by weight per 100 parts by weight of said trans-1,4-polyisoprene.

* * * * *